US009080242B2

(12) United States Patent
Bourgeois

(10) Patent No.: US 9,080,242 B2
(45) Date of Patent: Jul. 14, 2015

(54) PRESSURIZED ELECTROLYSIS STACK WITH THERMAL EXPANSION CAPABILITY

(75) Inventor: Richard Scott Bourgeois, Albany, NY (US)

(73) Assignee: General Electric Company, Schenectady, NY (US)

( * ) Notice: Subject to any disclaimer, the term of this patent is extended or adjusted under 35 U.S.C. 154(b) by 1903 days.

(21) Appl. No.: 12/242,767

(22) Filed: Sep. 30, 2008

(65) Prior Publication Data

US 2010/0078317 A1 Apr. 1, 2010

(51) Int. Cl.

| | |
|---|---|
| ***C25B 9/18*** | (2006.01) |
| ***C25B 9/08*** | (2006.01) |
| ***C25B 1/04*** | (2006.01) |
| ***C25B 15/00*** | (2006.01) |
| ***C25B 9/20*** | (2006.01) |
| ***C25B 1/10*** | (2006.01) |

(52) U.S. Cl.
CPC ..... *C25B 9/18* (2013.01); *Y10T 29/49002* (2015.01)

(58) Field of Classification Search
CPC ..... C25B 9/00; C25B 9/18; C25B 9/08; C25B 1/12; C25B 9/20; C25B 9/206
USPC ..... 204/252, 523, 254, 255, 257, 253, 242
See application file for complete search history.

(56) References Cited

U.S. PATENT DOCUMENTS

| | | | | |
|---|---|---|---|---|
| 4,090,939 A | | 5/1978 | Nicolas et al. | |
| 4,135,996 A | | 1/1979 | Bouy et al. | |
| 4,144,161 A | | 3/1979 | Bourgeois | |
| 4,243,497 A | | 1/1981 | Nicholas et al. | |
| 4,547,411 A | | 10/1985 | Bachot et al. | |
| 4,632,746 A | * | 12/1986 | Bergman | 204/415 |
| 4,695,489 A | | 9/1987 | Zarnoch et al. | |
| 5,500,583 A | | 3/1996 | Buckley et al. | |
| 6,087,036 A | * | 7/2000 | Rouillard et al. | 429/66 |
| 6,632,347 B1 | | 10/2003 | Buckley et al. | |
| 6,652,731 B2 | | 11/2003 | Cobley et al. | |

(Continued)

FOREIGN PATENT DOCUMENTS

JP 2001-130901 * 5/2001

OTHER PUBLICATIONS

English Translation of JP 2001-130901 to Harada.*

(Continued)

*Primary Examiner* — Zulmariam Mendez
(74) *Attorney, Agent, or Firm* — Jean K. Testa; Fletcher Yoder, P.C.

(57) ABSTRACT

The present techniques provide systems and methods for mounting an electrolyzer stack in an outer shell so as to allow for differential thermal expansion of the electrolyzer stack and shell. Generally, an electrolyzer stack may be formed from a material with a high coefficient of thermal expansion, while the shell may be formed from a material having a lower coefficient of thermal expansion. The differences between the coefficients of thermal expansion may lead to damage to the electrolyzer stack as the shell may restrain the thermal expansion of the electrolyzer stack. To allow for the differences in thermal expansion, the electrolyzer stack may be mounted within the shell leaving a space between the electrolyzer stack and shell. The space between the electrolyzer stack and the shell may be filled with a non-conductive fluid to further equalize pressure inside and outside of the electrolyzer stack.

17 Claims, 4 Drawing Sheets

(56) References Cited

U.S. PATENT DOCUMENTS

| | | | | |
|---|---|---|---|---|
| 6,736,954 | B2 | 5/2004 | Cobley et al. | |
| 6,773,573 | B2 | 8/2004 | Gabe et al. | |
| 6,911,068 | B2 | 6/2005 | Cobley et al. | |
| 7,188,478 | B2 | 3/2007 | Bourgeois | |
| 7,303,660 | B2 | 12/2007 | Buckley et al. | |
| 7,381,313 | B2 | 6/2008 | Libby et al. | |
| 2005/0072688 | A1* | 4/2005 | Meltser | 205/628 |
| 2006/0053792 | A1 | 3/2006 | Bourgeois | |
| 2006/0131167 | A1* | 6/2006 | Ramisch et al. | 204/253 |
| 2006/0228619 | A1 | 10/2006 | Bowen et al. | |
| 2006/0254907 | A1* | 11/2006 | Taruya et al. | 204/266 |
| 2007/0000789 | A1 | 1/2007 | Libby et al. | |
| 2007/0122339 | A1 | 5/2007 | Kulkarni et al. | |
| 2007/0278108 | A1 | 12/2007 | Rosenzweig et al. | |
| 2008/0083614 | A1 | 4/2008 | Swalla et al. | |
| 2008/0145746 | A1 | 6/2008 | Zappi et al. | |
| 2008/0145749 | A1 | 6/2008 | Lacovangelo et al. | |
| 2008/0145755 | A1 | 6/2008 | Lacovangelo et al. | |
| 2009/0236233 | A1* | 9/2009 | D'Astolfo et al. | 205/362 |

OTHER PUBLICATIONS

U.S. Appl. No. 12/136,331, filed Jun. 10, 2008, Zappi et al.
U.S. Appl. No. 12/136,383, filed Jun. 10, 2008, Swalla et al.
U.S. Appl. No. 12/136,439, filed Jun. 10, 2008, Swalla.
Electronic Development Labs, Inc., EDL Tool & Die, Typical Linear coefficient of expansion for common Plastics, http://www.edl-inc.com/Plastic%20expansion%20rates.htm, printed Aug. 1, 2008.
Handy Harman Canada, Comparisons of Materials: Coefficient of Thermal Expansion, http://www.handyharmancanada.com/TheBrazingBook/comparis.htm, printed Oct. 9, 2008.
Wikipedia, The Free Encylopedia, Thermal Expansion, http://en.wikipedia.org/wiki/Thermal_expansion, printed Aug. 1, 2008.

* cited by examiner

PRESSURIZED ELECTROLYSIS STACK WITH THERMAL EXPANSION CAPABILITY

STATEMENT REGARDING FEDERALLY SPONSORED RESEARCH & DEVELOPMENT

The present disclosure describes technique developed with Government support under contract number DE-FC07-06ID14789 awarded by the Department of Energy. The Government has certain rights in the techniques.

BACKGROUND

The present techniques generally relate to systems and methods for allowing thermal expansion of electrolysis stacks during operation. In particular, a method for allowing differential thermal expansion of an electrolysis stack and a shell enclosing the stack is disclosed.

Electrochemical devices are useful in chemical reactions in which electrons may participate as reactants or products. For example, an electrolytic cell may use electrical energy to split lower energy reactants into higher energy products, which may then be used as materials, reactants, or in power generation. In another example, voltaic cells and fuel cells may be used to chemically combine higher energy products to form lower energy products, releasing electrons that may be used to power other devices. While in voltaic cells, the electrode may be consumed during the reaction, in a number of other electrochemical devices, such as electrolytic cells and fuel cells, the electrode is not intended to be a reactant, but merely to catalyze the reaction and collect or donate the current from the reaction.

Electrolytic cells may be useful in a number of processes, such as the splitting of water into oxygen and hydrogen in an electrolyzer. The hydrogen generated may be used in chemical processes, such as hydroformulation or hydrocracking in refineries, or may be stored for later use, such as in the generation of energy in a fuel cell. Electrolyzers may be assembled from a stack of individual plastic components that are joined together to form a contiguous structure, generally by adhesives or welding.

Generally, making the individual components from plastics is desirable, as plastics are both easily formed and insulating. However, the relatively high coefficient of thermal expansion for many plastics may be problematic. Electrolyzer stacks are typically enclosed in an outer shell, which may be made from metal. Although the outer shell protects the electrolyzer stack and provides reinforcement from radial or hoop stress, the outer shell may have a much lower coefficient of thermal expansion than that of the plastic. For example, the coefficient of thermal expansion for many plastics may be about two to four times that of many metals. Accordingly, techniques are needed to allow thermal expansion of electrolyzer stacks within metal shells, while keeping stresses placed on the electrolyzer stack low enough to prevent damage or failure.

BRIEF DESCRIPTION

An embodiment of the present techniques provides an electrolyzer that includes an electrolyzer stack made of a plurality of electrolyzer cells placed adjacent to one another. Each electrolyzer cell includes an electrode assembly and a diaphragm assembly, and the diaphragm assembly of each electrolyzer cell is placed adjacent to an electrode assembly of another electrolyzer cell. A shell encloses the stack, the shell being spaced from the stack to permit differential thermal expansion of the stack and the shell during operation.

Another embodiment provides a method for allowing thermal expansion in an electrolyzer stack. The method includes mounting an electrolyzer stack within a shell, wherein a space is provided between the shell and the electrolyzer stack to allow thermal expansion of the stack within the shell. The space between the shell and the electrolyzer stack is filled with a non-conductive fluid. A pressure is maintained on the stack that is substantially the same as a pressure in an interior space within the stack.

A third embodiment provides a method of assembling an electrolyzer that includes assembling a plurality of electrolyzer cells, wherein each electrolyzer cell comprises a metal plate and a diaphragm, and wherein each electrolyzer cell has a structure configured to form a fluid channel when aligned with other electrolyzer cells. The plurality of electrolyzer cells is aligned to form an electrolyzer stack. A shell is disposed around the electrolyzer stack. The electrolyzer stack is spaced from the shell to allow differential thermal expansion of the electrolyzer stack and the shell.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
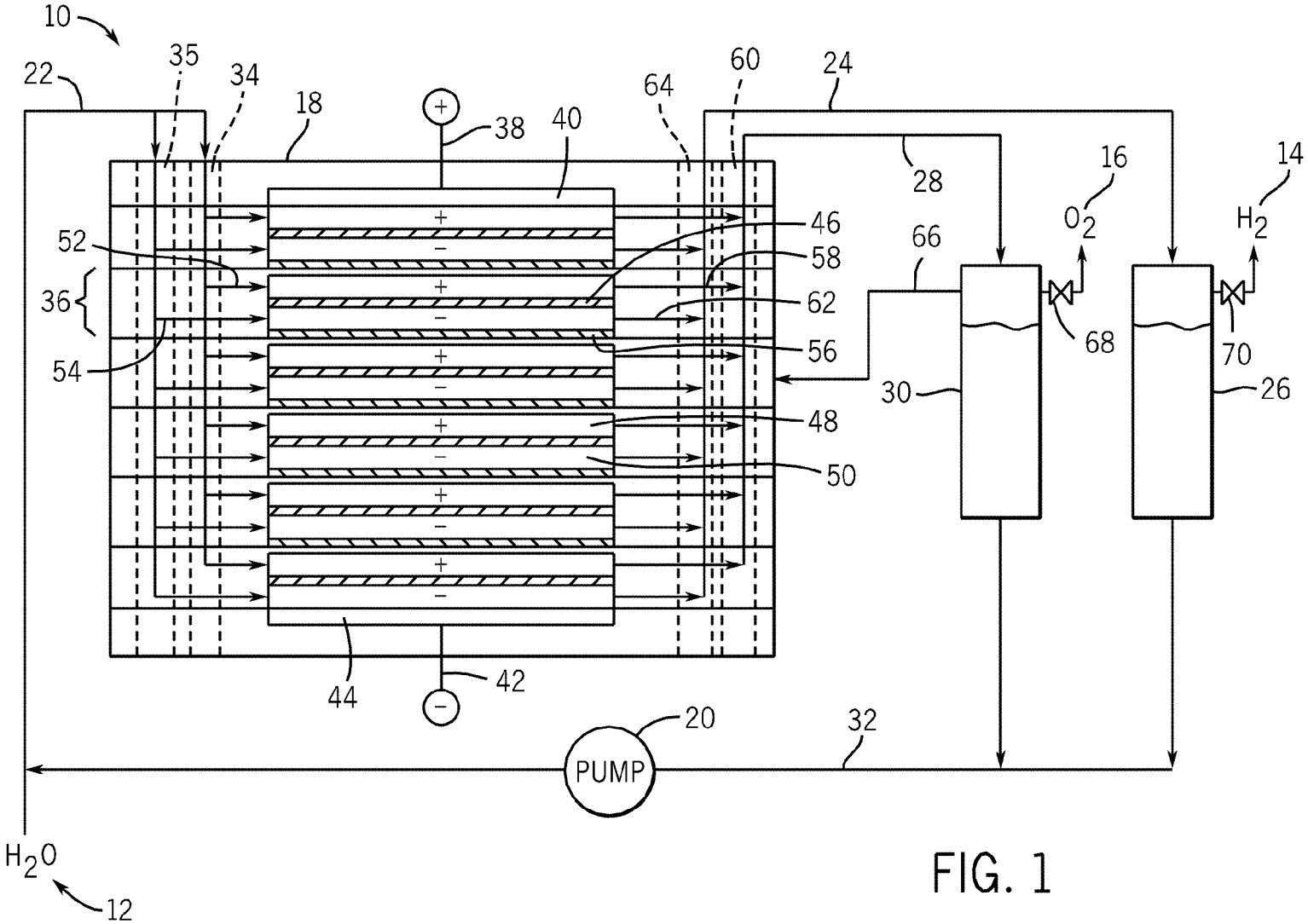
FIG. 1 is a diagrammatic representation of an electrolyzer system according to embodiments of the present techniques.

As discussed in detail below, the present techniques provide systems and methods for mounting an electrolyzer stack in an outer shell so as to allow for differential thermal expansion of the electrolyzer stack and shell. Generally, the electrolyzer stack may be formed from a plastic that may have a high coefficient of thermal expansion (CTE). For example, one plastic that may be used to form an electrolyzer stack is Noryl (a polyphenylene/polystyrene blend, available from SABIC Corp.), which has a CTE of about 72 micrometers/meter/° C. In contrast, the shell may be formed from a metal that may have a much lower coefficient of thermal expansion, such as steel, which has a CTE around 11 micrometers/meter/° C. During operation, the electrolyzer stack and shell are heated to about 80° C. by the current flow through the electrolyzer stack, leading to thermal expansion of each. The difference in thermal expansion may lead to damage of the electrolyzer stack.

As an example, an approximately 70 cm (28 inch) diameter electrolyzer stack made of Noryl may have a thermal expansion of as much as 0.32 cm (0.125 inches) over the temperature range from ambient to 80° C. However, a shell made from steel may only expand by about 0.05 cm (0.02 inches) over the same temperature range. Accordingly, the stack may constrain the thermal expansion of the electrolyzer stack in either an axial or a radial direction, damaging the electrolyzer stack. As electrolyzers increase in size, the problem may become more significant.

To allow for the differences in thermal expansion, the electrolyzer stack may be mounted within the shell leaving a space between the electrolyzer stack and shell. The mounting may be configured to hold the electrolyzer stack in place with a resilient mounting member, such as a spring, a metal clip, or a rubber block, among others. The resilient mounting member is generally located at one end of the stack, allowing the electrolyzer stack to expand axially as the temperature increases. However, other configurations may have resilient mounting members at both ends, and are considered to be within the scope of the invention. The space around the circumference of the electrolyzer stack may be adjusted to allow the stack to contact the shell at about the normal operating temperature of the electrolyzer, allowing the stack to expand during the temperature increase from ambient to the normal operating temperature. However, before the electrolyzer stack makes contact with the shell, significant stress may be placed on the outer circumference of the electrolyzer stack by internal pressures. This hoop stress may lead to damage or even a failure of the stack in the radial direction.

The electrolyzer stack may be protected from hoop stress by filling the space between the electrolyzer stack and the shell with a non-conductive fluid. The non-conductive fluid may be pressurized to match the internal pressure in the electrolyzer stack. For example, the non-conductively fluid may be fluidically coupled to a gas outlet from the electrolyzer stack, which would match the internal pressure in the electrolyzer stack to the pressure on the exterior surface of the electrolyzer stack. As the electrolyzer stack expands in the radial direction, the pressure matched fluid would be forced from the space between the electrolyzer stack and the shell and, thus, protect the electrolyzer stack from hoop stress until it made contact with the interior surface of the shell, at which point the shell would provide the reinforcement.

An example of an electrolyzer system 10 that may be assembled by the present techniques is illustrated by the schematic diagram of FIG. 1. In the electrolyzer system 10, water 12 is split into hydrogen 14 and oxygen 16 by an electrolyzer stack 18. In operation, a pump 20 maintains a continuous flow of an electrolyte solution 22 through the electrolyzer stack 18. Generally, the electrolyte solution 22 is an aqueous solution of about 20 wt % to about 40 wt. %, or about 30 wt %, potassium hydroxide (KOH) or sodium hydroxide (NaOH), although any number of other ionic solutions may be used. For example, the electrolyte solution 22 may contain lithium hydroxide or other metals.

As a portion of the water 12 is converted to hydrogen 14 and oxygen 16, additional water 12 is added prior to returning the electrolyte solution 22 to the electrolyzer stack 18. As discussed in further detail below, the electrolyzer stack 18 produces a hydrogen stream 24 containing bubbles of hydrogen 14 in the electrolyte solution 22. The hydrogen stream 24 is directed to a hydrogen separator 26, where the hydrogen 14 separates out and is collected for storage or use. The electrolyzer stack 18 also produces a separate oxygen stream 28 containing bubbles of oxygen 16 in the electrolyte solution 22, which is directed to an oxygen separator 30. In the oxygen separator 30, the oxygen 16 is separated from the electrolyte solution 22. The hydrogen separator 26 and oxygen separator 30 may generally function as reservoirs for the electrolyte solution 22. From the separators 26, 30 a return electrolyte solution 32 may be directed to the pump 20, where it is circulated to the electrolyzer stack 18.

In the electrolyzer stack 18, two inlet channels 34, 35 direct the electrolyte solution 22 to a number of individual electrolyzer cells 36. The inlet channels 34, 35 are formed by adjacently aligned apertures formed in each of the electrolyzer cells 36. The electrolyzer cells 36 are stacked and electrically connected in series by the electrolyte solution 22. Generally, the electrolyzer cells 36 are joined, for example, by welding, to form a single structure, in which the inlet channels 34, 35 form one of two sets of flow paths through the structure. However, the electrolyzer stack 18 may be assembled without forming a permanent bond between the electrolyzer cells 36, by placing the electrolyzer stack 18 under pressure during assembly and use. This holds the electrolyzer cells 36 together with sufficient pressure to form a hermetic seal between the individual electrolyzer cells 36. Further, these techniques may allow the electrolyzer stack 18 to be serviced by the replacement of or access to individual cells 36.

In the illustrated embodiment, the electrolyzer stack 18 contains 6 electrolyzer cells 36, although any number may be included, such as 10, 50, 75, 100, or more electrolyzer cells 36 depending on the current available and the production rates desired. At one end of the electrolyzer stack 18, a positive source 38 is connected to a positive current collector 40. At the other end of the electrolyzer stack 18, a negative source 42 is connected to a negative current collector 44. A metal plate 46 disposed within each of the electrolyzer cells 36 functions as a bipolar electrode. As current is passed through the electrolyte solution 22, a positive charge is induced on the side of the metal plate 46 closest to the positive current collector 40, forming an anodic surface 48. Similarly, a negative charge is induced on the side of the metal plate 46 closest to the negative current collector 44, forming a cathodic surface 50. The metal plate 46 may have a wire mesh welded to the surfaces 48, 50 to increase the surface area. The metal plate 46 and any attached wire mesh may be made from stainless steel, nickel, gold, or any other suitable metal or alloy, such as hastalloy, that will resist corrosion from the current and electrolyte solution 22.

Generally, during electrolysis, the difference in charge between the anodic surface 48 and cathodic surface 50 may be on the order of about 1.5 volts to about 2.2 volts. Accordingly, as the electrolyzer cells 36 are in series, the voltage supplied to the electrolyzer stack 18 will be increased to accommodate the number of electrolyzer cells 36 in the electrolyzer stack 18. For example, the voltage supplied to the electrolyzer stack 18 may range from about 15 to about 22 volts, for embodiments with 10 electrolyzer cells 36 and range from about 150 volts to about 220 volts, for embodiments with 100 electrolyzer cells 36. Other voltages, and indeed, other charge application schemes may also be envisaged.

During operation of the electrolyzer stack 18, the electrolyzer solution 22 is passed over the anodic surface 48 of the metal plate 46 through an anodic surface inlet channel 52 formed in each of the electrolyzer cells 36 and connected to inlet channel 34. A cathodic surface inlet channel 54 directs electrolyte solution 22 from inlet channel 35 over the cathodic surface 50 of the metal plate 46. The water 12 in the electrolyte solution 22 is split into oxygen 16 at the anodic surface 48 and hydrogen 14 at the cathodic surface 50. The bubbles of hydrogen 14 and oxygen 16 are isolated from each other by a liquid permeable membrane 56, which allows water and ions from the electrolyte solution 22 to flow and conduct current between the anodic surface 48 and the cathodic surface 50, but generally prevents the transfer of gas. The liquid permeable membrane 56 may be made from any number of hydrophilic polymers, including, for example, polysulfones, polyacrylamides, and polyacrylic acids, among others.

The oxygen stream 28 formed at the anodic surface 48 in each of the electrolyzer cells 36 is directed through an anodic surface outlet channel 58 to an oxygen outlet channel 60. From the oxygen outlet channel 60, the oxygen stream 28 is directed to the oxygen separator 30. Similarly, the hydrogen stream 24 formed at the cathodic surface 50 of each of the electrolyzer cells 36 is directed through a cathodic surface outlet channel 62 to a hydrogen outlet channel 64. From the hydrogen outlet channel 64, the hydrogen stream 24 is directed to the hydrogen separator 26. As for the inlet channels 34, 35, the electrolyzer cells 36 have adjacently aligned apertures that form the outlet channels 60, 64 when electrolyzer cells 36 are joined together to form the final structure. Accordingly, it is desirable that the electrolyzer cells 36 be hermetically sealed to each other to prevent mixing of the hydrogen 14 and oxygen 16 between the outlet channels 60, 64, or other parts of the electrolyzer stack 18.

As discussed above, the pressure on the inside of the electrolyzer stack 18 may be equalized with pressure outside of the electrolyzer stack 18. This may be performed in any number of ways. For example, in a contemplated embodiment, a fluidic coupling 66 may be made with the gas in the oxygen reservoir 30 to a space surrounding the electrolyzer stack 18, as discussed below. As the oxygen reservoir 30 is generally at the same pressure as the inside of the electrolyzer stack 18, this would maintain an exterior space at the same pressure as the interior space. The fluidic coupling 66 does not have to be made to the oxygen reservoir 30, but could be to the hydrogen reservoir 26, or to either of the outlet streams 24, 28. The back pressure on the stack is generally maintained by outlet valves 68, 70 located on the outlet lines from the reservoirs 30, 26. As the reservoirs 30, 26 will generally be held at the same pressures, the outlet valves 68, 70 may be two sides of a single multi-gang valve, allowing both outlet valves to be adjusted together.

Figure 2:
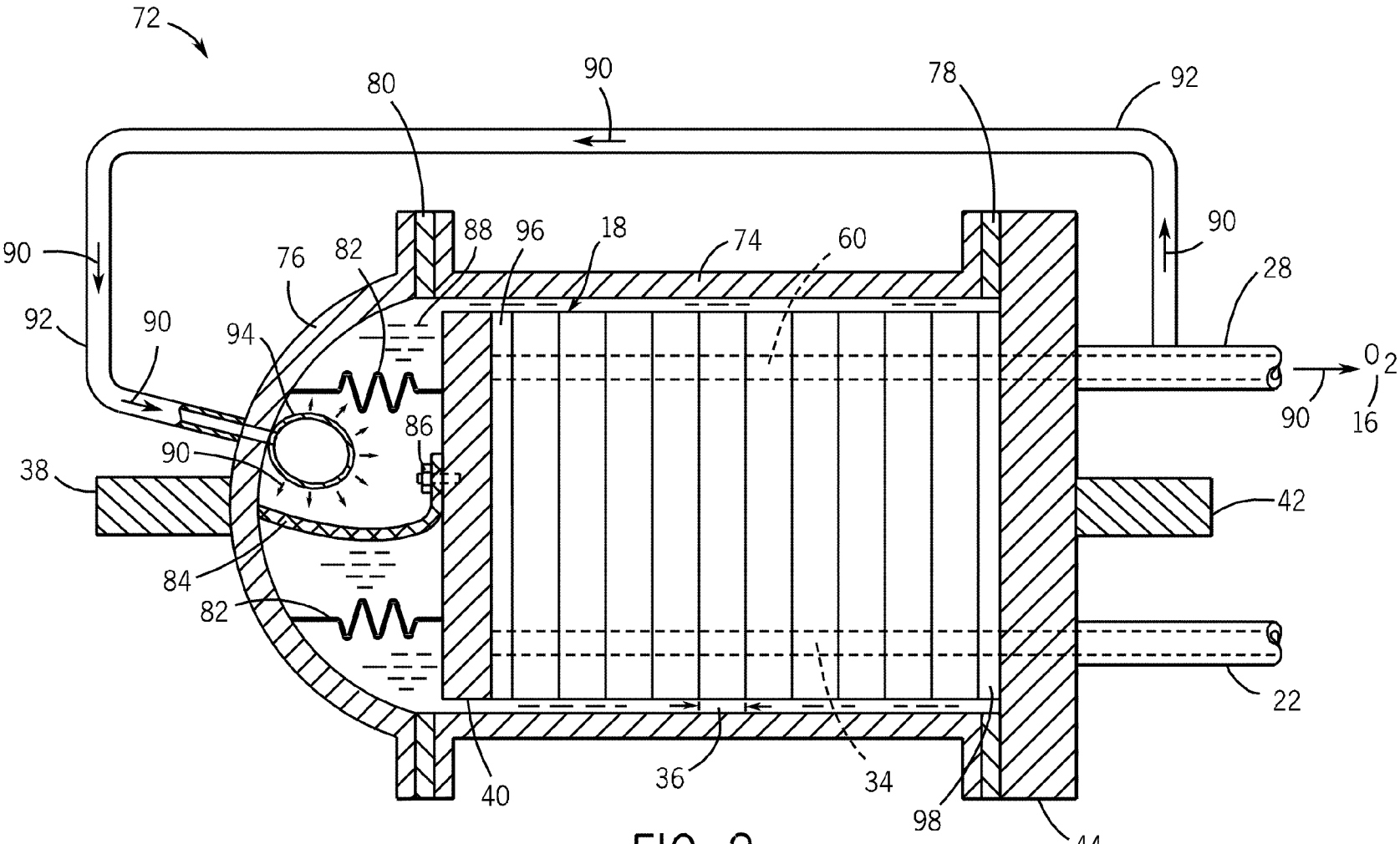
FIG. 2 is a cross section of an electrolyzer system according to embodiments of the present techniques.

The electrolyzer stack 18 may be mounted in an enclosure as illustrated in the cross section shown in FIG. 2, forming an electrolyzer 72. The electrolyzer 72 has connections for the inlet channels, such as inlet channel 35, to allow the flow of electrolyte solution 22 into the electrolyzer 72. The electrolyzer 72 also has connections for the oxygen outlet channel 60 to allow the oxygen stream 28 to be removed, and the hydrogen outlet channel (not shown in this cross sectional view) to allow the hydrogen stream 24 to be removed. The electrolyzer stack 18 is mounted to a positive current collector 40, located on one end of the electrolyzer stack 18, which may be connected to a positive source 38. The opposite end of the electrolyzer stack 18 is mounted to a negative current collector 44 which may be connected to a negative source 42. The negative current collector 44 may be used as one end cap of the electrolyzer 72. Further, although the negative current collector 44 is shown as the end cap, it should be understood that this is merely one example, and other configurations may be contemplated. Further, the polarities of the negative and positive current collectors 40, 44 may be reversed.

The electrolyzer 72 has a body 74 that forms the enclosure around the electrolyzer stack 18, and a head 76 opposite the negative current collector 44. The body 74 may be joined to the negative current collector 44 with a first insulating gasket 78, which prevents current from flowing to the body from the negative current collector 44. A second insulating gasket 80 is placed between the body 74 and the head 76 to prevent current from flowing to the body 74 from the head 76. The negative current collector 44, body 74, and head 76 may be constructed from any suitable materials, such as stainless steel, hastalloy, nickel, and so forth. Further, the body 74 and head 76 do not have to be made from metal, as a high performance plastic may provide sufficient properties. Suitable high performance plastics may include, for example, polyphenylene sulfide (PPS) or poly(ether-ether-ketone) (PEEK), among others. Moreover the parts may be made of the same material or may be of different materials. For example, the negative current collector 44 and the head 76 may be made from stainless steel, while the body 74 may be made from a high-performance plastic, thereby insulating the negative current collector 44 from the head 76.

As shown in the illustrated embodiment, the head 76 may be hemispherical to allow for space between the positive current collector 40 and the head 76. Other configurations for the head 76 may also be envisioned. For example, the head 76 could retain the cylindrical shape of the body 74, but extend out from the positive current collector 40 to allow for expansion of the electrolyzer stack 18. Resilient mounting members 82, configured to hold pressure on the electrolyzer stack 18, may be located between the head 76 and the electrolyzer stack 18 to hold the electrolyzer stack 18 in place against the negative current collector 44. As previously noted, the individual electrolyzer cells 36 may be permanently sealed to one another, or the pressure from the resilient mounting members 82 may be sufficient to form a hermetic seal between the electrolyzer cells 36. The resilient mounting members 82 may be made from a conductive material to form a current path between the head 76, which is connected to a positive current source 38, or an electrical coupling 84 may be connected between the head 76 and the positive current collector 40. The electrical coupling 84 may be any number of flexible current conductors, such as a braided wire cable affixed by a bolt 86 to the positive current collector 40.

The space within the electrolyzer 72 surrounding the electrolyzer stack 18 may be filled with a non-conductive fluid 88. The non-conductive fluid 88 would provide both a non-compressible media for applying pressure to the exterior surface of the electrolyzer stack 18 and also insulate the negative current collector 44 from the positive current collector 40. The non-conductive fluid 88 may include deionized or distilled water, mineral oil, or a fluid plastic resin, among others. The choice of the non-conductive fluid 88 may be made on the basis of cost, availability, risk of ionizing contamination, and ease of use, among others. For example, deionized water may provide a low cost, easily available media that will not attack plastic parts. However, deionized water is susceptible to ionic contamination that lowers its resistance, potentially leading to the formation of a current path between the negative current collector 44 and the positive current collector 40. In contrast, mineral oil will generally not dissolve electrolytes and, thus, may maintain its insulating capabilities. However, mineral oil may be more expensive and may attack some plastic parts.

As previously discussed, an electrolyte solution 22 may be provided to an inlet channel in the electrolyzer stack 18, such as inlet channel 35. The electrolyte solution 22 flows through each of the electrolyzer cells 36, where electrolysis occurs. The gas formed flows out of the electrolyzer cell 36 through an outlet channel, such as hydrogen outlet channel 64. The hydrogen stream 24 then leaves the electrolyzer 72 at a pressure 90 that is substantially the same as the pressure inside the electrolyzer stack 18.

The oxygen stream 28 may be connected to a line 92 to couple the outlet pressure 90 to the non-conductive fluid 88. This may be performed by mounting a volume compensation member 94, such as an inflatable bladder, within the non-conductive fluid 88 inside the head 76 of the electrolyzer 72. Other configurations for the volume compensation member 94 may be envisioned. For example, the volume compensation member 94 may be a cylinder containing a piston mounted outside of the head 76. One side of the piston may be fluidically coupled to the non-conductive fluid 88 within the shell, while the other side of the piston may be fluidically coupled to the line 92. As the pressure 90 on the outlet changes, the volume compensation member 94 would expand or contract to place a substantially matching pressure on the non-conductive fluid 88 and, thus, match the pressure on the exterior surface of the electrolyzer stack 18 with the pressure 90 inside the electrolyzer stack 18. The line 92 does not have to be coupled to the oxygen stream 28 as a coupling to the hydrogen stream (not shown) would also provide a pressure 90 that matches the internal pressure of the electrolyzer stack 18. Further, as discussed with respect to FIG. 1, the line 92 may be attached to the gaseous headspace of a gas separator 26, 30 used to isolate a gas from an outlet stream 24, 28.

The volume compensation member 94 may be made from any number of flexible, chemical resistant plastics. For example, the volume compensation member 94 may be made from a silicone rubber, a polyester, a polyamide, a polyolefin copolymer, or any combinations thereof. Further, the inside and outside surfaces of the volume compensation member 94 may be made from different materials formed into a multi-layer laminated structure. This could provide an volume compensation member 94 that is resistant and impermeable to the electrolyte solution 22, which may contact the inner surface, and is also resistant to the non-conductive fluid 88 in contact with the outer surface.

The individual electrolyzer cells 36 of the electrolyzer stack 18 are generally not in direct contact with the negative current collector 44 and the positive current collector 40. For example, the electrolyzer stack 18 may be spaced apart from the positive current collector 40 by one or more gaskets 96 that allow solution flow around the last electrolyzer cell 36 in the electrolyzer stack 18. For similar reasons, one or more spacer plates 98 may be located between the electrolyzer stack 18 and the negative current collector 44.

Figure 3:
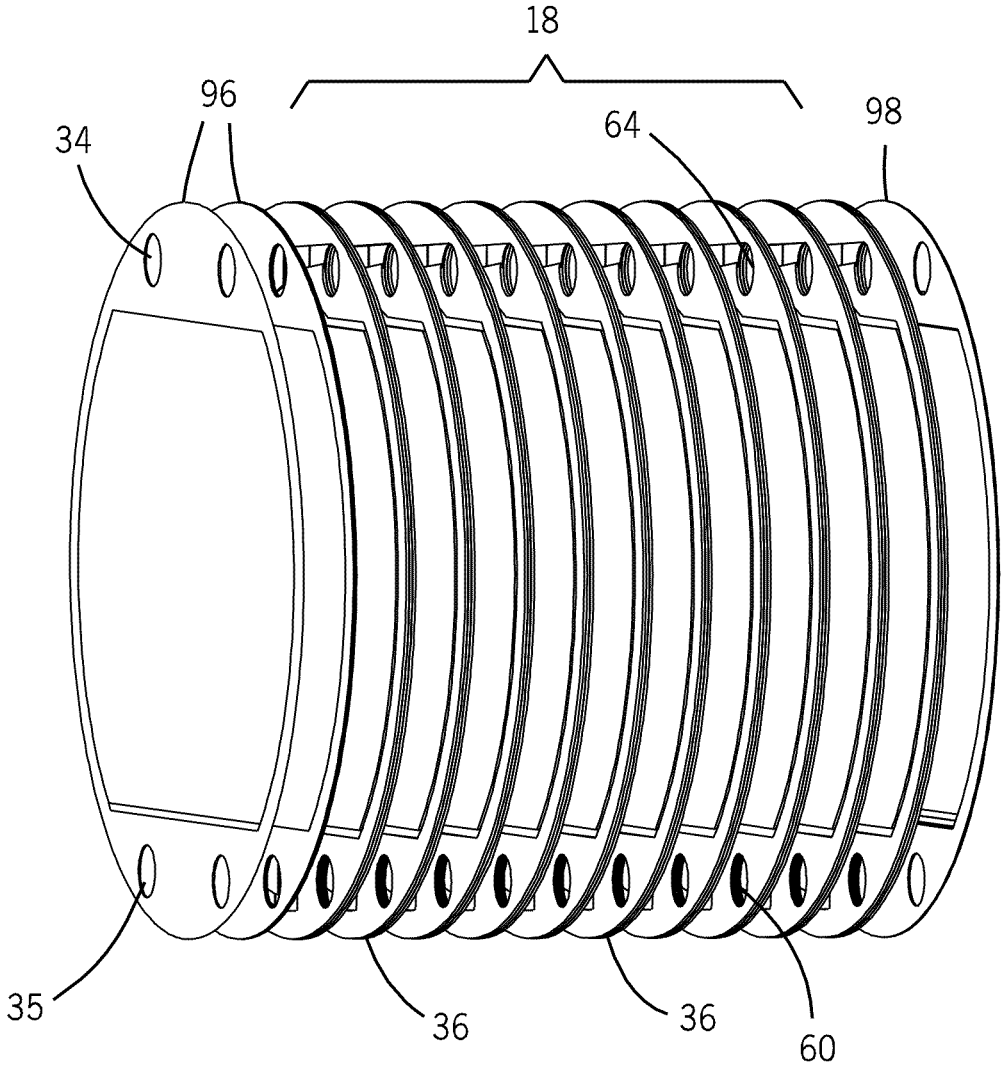
FIG. 3 is an exploded view of the electrolyzer stack of FIG. 2, showing the individual electrolyzer cells.

A more detailed view of parts that may be used to form the electrolyzer stack 18 is shown in the expanded view of FIG. 3. The electrolyzer stack 18 is assembled by stacking the electrolyzer cells 36 together to form a single unit, with the apertures in each of the electrolyzer cells 36 aligned to form the inlet channels 34, 35 and outlet channels 60, 64. The alignment of the electrolyzer cells 36 may be performed by inserting one or more alignment bars (not shown) through the channels 34, 35, 60, and 64. Further, the electrolyzer cells 36 may be aligned by mating protrusions (not shown) in the surface of each electrolyzer cell 36 with corresponding indentations on an adjoining electrolyzer cell 36.

It should be noted that additional elements may also be placed between the electrolyzer cells 36 to aid in assembly and/or sealing. For example, the electrolyzer cells 36 may be mated through the intermediary of a seal or seal assembly (not shown) that may be placed between adjacent cells or cell elements (i.e., adjacent electrode and diaphragm assemblies). Such seals may be disposed on a surface of one or both of the adjacent elements, or may be recessed in grooves or other structures formed or machined into the elements.

Figure 4:
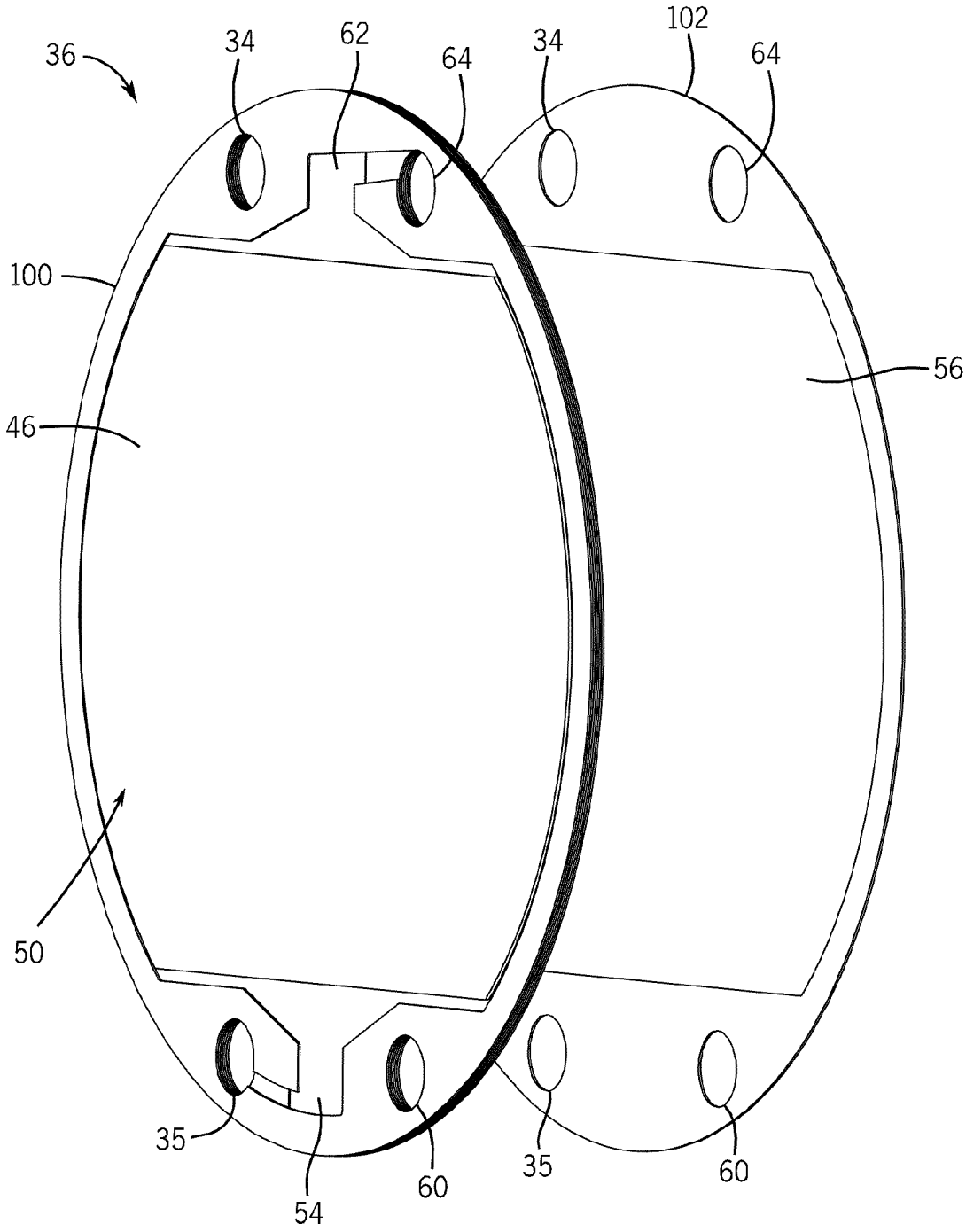
FIG. 4 is a perspective view of an exemplary electrolytic cell that may be used in the electrolyzer of FIG. 3.

An individual electrolyzer cell 36 that may be used in the electrolyzer stack 18 is shown in the perspective view of FIG. 4. The electrolyzer cell 36 generally includes two parts, an electrode assembly 100 mounted to a diaphragm assembly 102. Both assemblies 100, 102 have apertures which align with one another, and with other electrolyzer cells to form the inlet channels 34, 35 and the outlet channels 60, 64. The electrode assembly 100 holds the metal plate 46 that forms the bipolar electrode. As illustrated in FIG. 4, one side of the electrode assembly 100 has the cathodic surface inlet channel 54 molded in to direct flow of the electrolyte solution 22 from the cathode inlet channels 35 across the cathodic surface 50 of the metal plate 46. The flow with entrained hydrogen bubbles is then directed to the hydrogen outlet channel 64 via the cathodic surface outlet channel 62, which may also be molded into the electrode assembly 100. An analogous set of channels (not shown) on the opposite side of the metal plate 46 directs the flow of electrolyte solution 22 and oxygen 16 across the anodic surface 48.

The electrode assembly 100 and the diaphragm assembly 102 may be made from any number of materials, including a non-conductive, chemically resistant plastic. The plastic material may generally be chemically resistant to an oxidative environment, a reducing environment, an acidic environment, a basic environment, or any combination thereof. For example, the frames of the assemblies 100, 102, may be made from polyimides, polyamides, polyetheretherketones, polyethylenes, fluorinated polymers, polypropylenes, polysulfones, polyphenylene oxides, polyphenylene sulfides, polyphenylethers, polystyrenes, polyether imides, epoxies, polycarbonates, impact-modified polyethylene, impact-modified fluorinated polymers, impact-modified polypropylenes, impact-modified polysulfones, impact-modified polyphenylene oxides, impact-modified polyphenylethers, impact-modified polyphenylene sulfides, impact-modified polystyrene, impact-modified polyetherimide, impact-modified epoxies, impact-modified polycarbonates, or any combinations thereof. Other polymers that may be used include high performance blends, such as Noryl, which is a blend of polyphenylether and polystyrene (PS) (available from SABIC Innovative Plastics of Pittsfield, Mass.).

The materials selected for the electrode assembly 100 and diaphragm assembly 102 will determine the allowable pressure differential range between the exterior surface of the electrolyzer stack 18 and the interior surface of the electrolyzer stack 18. For example, an electrolyzer stack 18 formed from a strong polymer, such as a polyimide, may not use continuous pressure compensation between the inside and outside of the electrolyzer stack 18. In this contemplated embodiment, the volume compensation member 94 may be pressured to a fixed value after assembly. However, a polyimide may be less desirable due to cost and/or processing difficulty. In contrast, an easily formable plastic, such as impact-modified polystyrene, may use the internal stack pressure 90 on the volume compensation member 94, such as provided by line 92, to prevent damage to the electrolyzer stack 18.

Further, if the electrolyzer cells 36 are not permanently joined together, the materials selected for the electrode assembly 100 and diaphragm assembly 102 will determine the pressure that needs to be applied to the electrolyzer stack 18 by the resilient mounting member 82 to form a hermetic seal between each electrolyzer cell 36. Specifically, the compliance, or modulus, of the plastic will determine what applied pressure will result in formation of a seal. If the pressure is too low relative to the compliance, the plastic may not adequately seal, allowing the hydrogen 14 and oxygen 16 to mix through leaks between the outlet channels 60, 64. If the pressure is too high, the plastic may crack, also allowing leaks to form. In presently contemplated embodiments, the pressure applied to the electrolyzer stack 18 by the resilient mounting member 82 may be about 2 bar, 3 bar, 5 bar, 7 bar, 9 bar, or higher.

The diaphragm assembly 102 may be permanently joined to the electrode assembly 100 to form the electrolyzer cell 36. The two assemblies 100, 102 may be joined by any number of techniques including adhesives, ultrasonic welding, thermal welding, compression, and so forth. The diaphragm assembly 102 holds the liquid permeable membrane 56, which prevents mixing of oxygen 16 formed on the anodic surface 48 of the metal plate 56 with hydrogen 14 formed on the cathodic surface 50 of an adjoining metal plate. In other contemplated embodiments, the electrode assembly 100 and diaphragm assembly 102 may be left as separate units, and held together by pressure in the final assembled electrolyzer 72.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An electrolyzer, comprising:

an electrolyzer stack comprising a plurality of electrolyzer cells placed adjacent to one another, wherein each electrolyzer cell comprises an electrode assembly and a diaphragm assembly, and the diaphragm assembly of each electrolyzer cell is placed adjacent to an electrode assembly of another electrolyzer cell;

a shell enclosing the stack and coupled to the stack via a resilient mounting member comprising a spring, the shell being spaced from the stack to permit differential thermal expansion of the stack and the shell during operation, wherein the space between the shell and the stack is substantially filled with a non-conductive fluid, wherein the resilient mounting member is configured to allow for the thermal expansion of the stack while maintaining a resilient mounting member pressure on the stack;

a gas outlet external to the shell and coupled to the stack; and a volume compensation member enclosed by the shell and configured to apply pressure to the non-conductive fluid, wherein the volume compensation member is fluidically coupled to the gas outlet to receive oxygen, hydrogen, or both from the stack.

2. The electrolyzer of claim 1, wherein the differential thermal expansion is radial to the stack.

3. The electrolyzer of claim 1, wherein the differential thermal expansion is along an axis of the stack.

4. The electrolyzer of claim 1, wherein a pressure of the non-conductive fluid is equalized with a pressure within the stack.

5. The electrolyzer of claim 1, comprising a fluid channel comprising an inlet channel for introducing an electrolyte solution into the electrolyzer, wherein the gas outlet comprises an outlet channel for removing the oxygen, the hydrogen, or both from the stack, or any combinations thereof.

6. The electrolyzer of claim 1, comprising a gas separator fluidically coupled between the gas outlet and the volume compensation member.

7. The electrolyzer of claim 1, wherein the electrolyzer stack comprises polyimides, polyamides, polyether ether ketones, polyethylenes, fluorinated polymers, polypropylenes, polysulfones, polyphenylene oxides, polyphenylene sulfides, polyphenylene ethers, polystyrenes, polyether imides, epoxies, polycarbonates, impact-modified polyethylene, impact-modified fluorinated polymers, impact-modified polypropylenes, impact-modified polysulfones, impact-modified polyphenylene oxides, impact-modified polyphenylene sulfides, impact-modified polystyrene, impact-modified polyetherimide, impact-modified epoxies, impact-modified polycarbonates, or any combination thereof.

8. A method for allowing thermal expansion in an electrolyzer stack, comprising:

mounting an electrolyzer stack within a shell, wherein the electrolyzer stack comprises a plurality of electrolyzer cells each comprising a metal plate and a diaphragm, wherein a space is provided between the shell and the electrolyzer stack to allow thermal expansion of the stack within the shell;

filling the space with a non-conductive fluid;

mounting a resilient mounting member comprising a spring between the shell and the stack to allow for differential thermal expansion of the stack while maintaining a resilient mounting member pressure on the stack; and maintaining a pressure on the stack that is substantially the same as a pressure in an interior space within the stack;

fluidically coupling a gas outlet external to the shell and coupled to the stack to a volume compensation member to receive oxygen, hydrogen, or both from the stack to equalize a pressure on the exterior of the stack with a pressure on the interior of the stack.

9. The method of claim 8, comprising applying a pressure on an exterior surface of the stack, wherein the pressure is substantially equal to a pressure within the stack, while allowing for differential thermal expansion of the stack and shell in a radial direction.

10. The method of claim 8, comprising mounting the volume compensation member in the space for applying a pressure to the non-conductive fluid.

11. A method of assembling an electrolyzer, comprising:

assembling a plurality of electrolyzer cells, wherein each electrolyzer cell comprises a metal plate and a diaphragm, and wherein each electrolyzer cell has a structure configured to form a fluid channel when aligned with other electrolyzer cells;

aligning the plurality of electrolyzer cells to form an electrolyzer stack;

disposing a shell around the electrolyzer stack, the electrolyzer stack being spaced from the shell to allow differential thermal expansion of the electrolyzer stack and the shell;

coupling the shell to the stack via a resilient mounting member comprising a spring, wherein the resilient mounting member is configured to allow for the thermal expansion of the stack while maintaining a resilient mounting member pressure on the stack; and mounting a volume compensation member within the space for applying a pressure to non-conductive fluid in the shell;

fluidically coupling the volume compensation member with a gas outlet external to the shell and coupled to the stack to receive oxygen, hydrogen, or both from the stack.

12. The method of claim 11, comprising filling the space with the non-conductive fluid.

13. The method of claim 12, comprising fluidically coupling a gas outlet from the stack to the non-conductive fluid to equalize a pressure in the space with a pressure inside the stack.

14. The method of claim 11, wherein fluidically coupling the volume compensation member with a gas outlet comprises fluidically coupling a gas separator between the gas outlet and the volume compensation member.

15. The electrolyzer of claim 1, wherein the resilient mounting member is configured to maintain the resilient mounting member pressure on the stack to form a hermetic seal between the plurality of electrolyzer cells of the stack.

16. The method of claim 11, comprising maintaining the resilient mounting member pressure on the stack to form a hermetic seal of the stack.

17. The method of claim 8, comprising maintaining the resilient mounting member pressure on the stack to form a hermetic seal of the stack.

* * * * *